US009004257B2

(12) United States Patent
Philipp et al.

(10) Patent No.: US 9,004,257 B2
(45) Date of Patent: Apr. 14, 2015

(54) SENSOR DEVICE IN A BANK NOTE PROCESSING MACHINE

(75) Inventors: Achim Philipp, Munich (DE); Jens Wolfarth, Munich (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 14/236,922

(22) PCT Filed: Jul. 6, 2012

(86) PCT No.: PCT/EP2012/002862
§ 371 (c)(1),
(2), (4) Date: Feb. 4, 2014

(87) PCT Pub. No.: WO2013/017193
PCT Pub. Date: Feb. 7, 2013

(65) Prior Publication Data

US 2014/0158495 A1 Jun. 12, 2014

(30) Foreign Application Priority Data

Aug. 4, 2011 (DE) ..... 10 2011 109 400

(51) Int. Cl.
*G07D 7/00* (2006.01)
*G07D 11/00* (2006.01)

(52) U.S. Cl.
CPC ..... *G07D 7/00* (2013.01); *G07D 11/0063* (2013.01); *G07D 11/0021* (2013.01)

(58) Field of Classification Search
CPC ..... G07D 7/00; G07D 11/0021
USPC ..... 194/200, 206, 207, 353; 15/1; 134/15, 134/16, 122 R, 137, 201; 399/18, 20, 21, 34, 399/71, 343, 345
See application file for complete search history.

(56) References Cited

U.S. PATENT DOCUMENTS

| | | | | |
|---|---|---|---|---|
| 4,583,398 | A | 4/1986 | Mitzel et al. | |
| 6,472,670 | B1 | 10/2002 | Philipp et al. | |
| 8,397,339 | B2 * | 3/2013 | Kato | 15/250.001 |
| 8,421,046 | B2 | 4/2013 | Leuthold | |

(Continued)

FOREIGN PATENT DOCUMENTS

| | | | |
|---|---|---|---|
| DE | 3242789 | C1 | 3/1984 |
| DE | 202007017409 | U1 | 2/2008 |

(Continued)

OTHER PUBLICATIONS

International Search Report for corresponding International PCT Application No. PCT/EP2012/002862, mailed Sep. 21, 2012, (5 pages).

*Primary Examiner* — Mark Beauchaine
(74) *Attorney, Agent, or Firm* — Workman Nydegger

(57) ABSTRACT

A sensor device in a banknote processing machine comprising a transport device by means of which banknotes to be processed are transported past the sensor device, a cleaning device that cleans the sensor device or a transparent region of the sensor device, and a control device that controls the components of the banknote processing machine. The sensor device includes means for enlarging the spacing between the transport device and the sensor device. The control device controls the means and the cleaning device in such a way that the spacing between the transport device and the sensor device is enlarged by the means while the cleaning device cleans the sensor device.

16 Claims, 2 Drawing Sheets

(56) References Cited

U.S. PATENT DOCUMENTS

Figure 1:
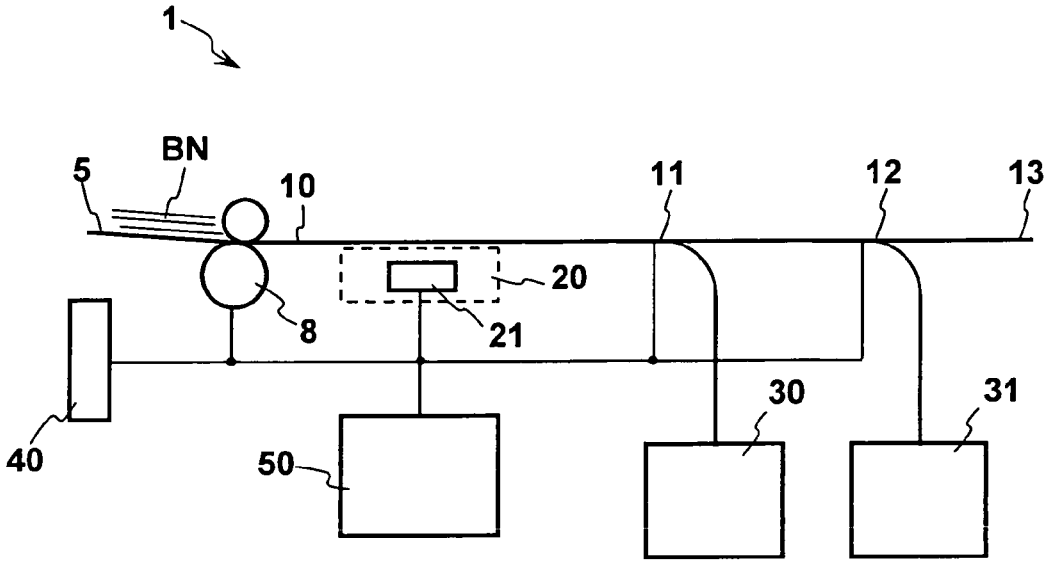

| | | | |
|---|---|---|---|
| 8,485,337 | B2 | 7/2013 | Demmeler |
| 8,561,252 | B2 | 10/2013 | Demmeler |
| 2011/0046774 | A1 | 2/2011 | Demmeler |
| 2011/0162679 | A1 | 7/2011 | Demmeler |
| 2011/0180694 | A1 | 7/2011 | Leuthold |
| 2011/0185530 | A1 | 8/2011 | Kato |

FOREIGN PATENT DOCUMENTS

| | | | |
|---|---|---|---|
| DE | 10 2007 037 923 | A1 | 2/2009 |
| DE | 10 2008 021 517 | A1 | 11/2009 |
| DE | 102008046254 | A1 | 3/2010 |
| EP | 1064624 | B1 | 10/2002 |
| EP | 2352132 | A1 | 8/2011 |

* cited by examiner

SENSOR DEVICE IN A BANK NOTE PROCESSING MACHINE

BACKGROUND

The present invention relates to a sensor device in a bank note processing machine.

SUMMARY

In bank note processing machines, bank notes can be evaluated with respect to a great variety of criteria, in order to ascertain certain properties of the bank notes to be processed. These properties relate to currency, bank note value, authenticity, bank note quality, bank note state etc. The evaluation is effected on the basis of data that are generated during the processing of the respective bank note in the bank note processing machine. These data are obtained on the basis of various physical peculiarities of the bank notes. Upon processing these physical peculiarities of the respective bank note are measured by means of different sensors to generate the data for the evaluation. In particular, there are also employed sensors here that generate image data. Such sensors can be formed for example by line-scan cameras, which generate image data in various spectral regions that can range from the infrared via the visible region up into the ultraviolet region, while the respective bank note is moved past the sensor by a transport device. In addition, it is known to employ other sensors, such as mechanical sensors or ultrasonic sensors for checking bank notes in bank note processing machines. The data of the sensors are processed in a connected evaluation unit. In so doing, the mentioned properties of the bank notes, such as type (currency, denomination), authenticity, quality, state etc., are ascertained from the data of one or several sensors by algorithms, and the bank notes can be sorted for example in accordance with the ascertained properties.

It is customary to mount the sensors in housings for protecting them from soiling. The housings normally have a region that is transparent to the sensor, which is respectively contained in the housing, and is facing the transport device in such a way that the bank notes transported past by the transport device can be captured as described above. For optical sensors that generate image data by means of a line-scan camera the transparent region can be formed for example by a window made of glass, which is transmissive to the spectral region employed by the sensor.

However, it has turned out in the operation of bank note processing machines that by the employment of housings for the sensors the sensors are protected well from soiling, but the deposits of dirt on the transparent regions, e. g. of dust on the above-described windows have proven to be a problem for optical sensors.

This problem could have partly been eliminated in that the transparent regions of the housing are cleaned by compressed air in processing pauses, i. e. when no bank notes are transported past the sensor device by the transport device.

However, upon the cleaning with compressed air it has been found that by the compressed air there is not only removed dirt from the surface of the sensor device, but that in some cases a considerable new soiling is caused.

It is therefore the object of the present invention to state a sensor device in a bank note processing machine, in which a new soiling of the sensors during a cleaning of the sensor device is avoided.

This object is achieved according to the invention by the features of claim 1.

The invention starts out from a sensor device in a bank note processing machine, having a transport device that transports bank notes to be processed past the sensor device, a cleaning device that cleans the sensor device or a transparent region of the sensor device, and a control device controlling the constituents of the bank note processing machine, having means for enlarging a distance between the transport device and the sensor device, wherein the control device drives the means and the cleaning device in such a way, that the distance between the transport device and the sensor device is enlarged by the means during the cleaning of the sensor device by the cleaning device.

The advantage of the invention is in particular to be seen in the fact that a new soiling is prevented in that upon the cleaning no dirt can come off from the parts of the transport device, in particular moving parts, that are proximate to the sensor device.

BRIEF DESCRIONION OF THE DRAWINGS

Further advantages of the present invention appear from the dependent claims as well as the following description of embodiments according to the invention with reference to Figures.

There are shown

Figure 2:
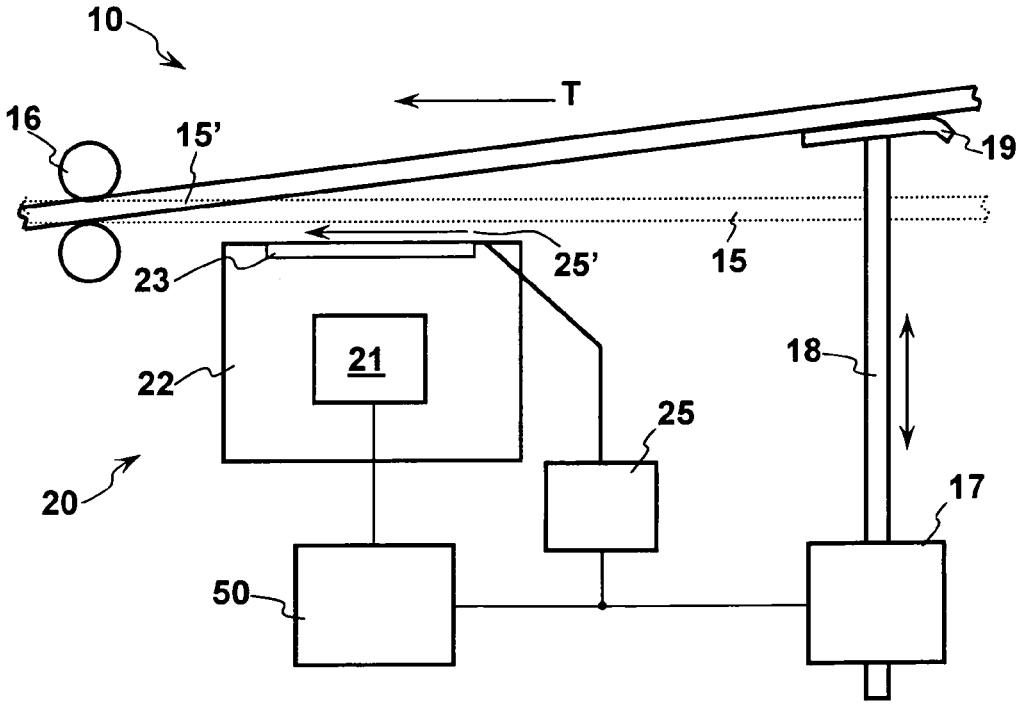
Figure 3:
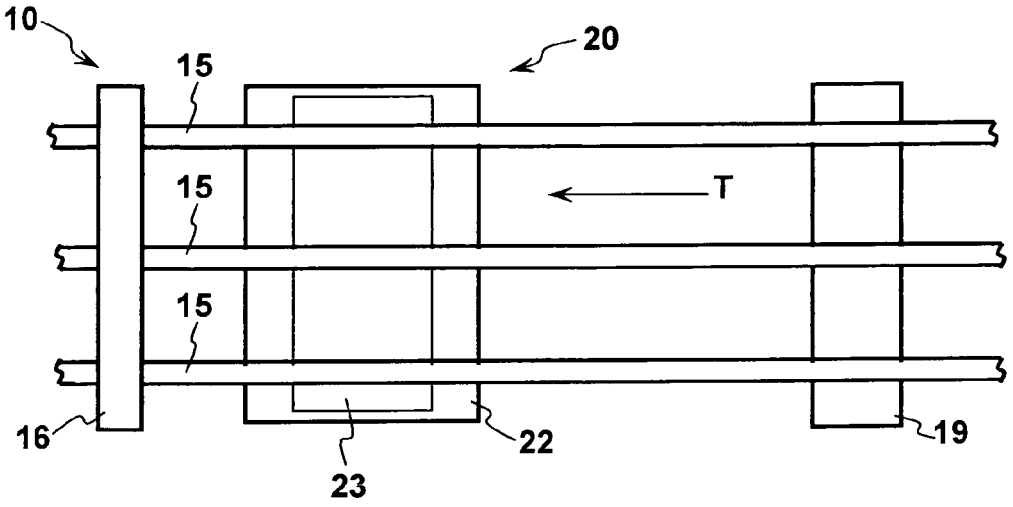

FIG. 1 a schematic representation of a bank note processing machine,

FIG. 2 a first embodiment of a sensor device in a first perspective,

FIG. 3 the embodiment of FIG. 2 in a second perspective, and

Figure 4:
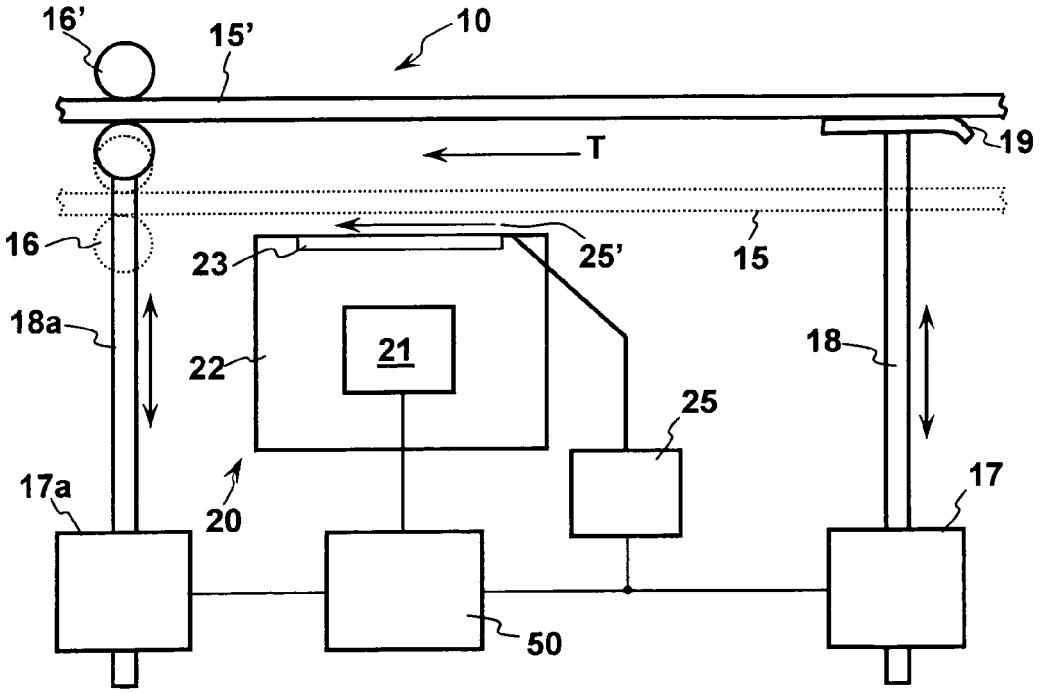

FIG. 4 a second embodiment of a sensor device.

DETAILED DESCRIPTION OF VARIOUS EMBODIMENTS

FIG. 1 shows a schematic representation of a bank note processing machine.

The bank note processing machine 1 has an input pocket 5 for bank notes BN to be processed. For operating the bank note processing machine 1 by an operator, an input/output device 40 is provided. The input/output device 40 can be formed by a keyboard and a display or by a touchscreen. All the constituents of the bank note processing machine 1 are controlled by a control device 50, which is formed e. g. by at least one microcomputer.

Bank notes BN input in the input pocket 5 of the bank note processing machine 1 are grasped individually by a singler 8 and transferred to a transport device 10, which transports the single bank note BN past a sensor device 20. During the transport of the single bank note BN past the sensor device 20 one or several sensors 21 of the sensor device 20 capture the bank note BN and generate data characterizing the bank note BN. The sensor device 20 can contain for example sensors 21 that generate image data. Such sensors 21 can be formed for example by line-scan cameras, which generate image data in one or several spectral regions that can range from the infrared via the visible region up into the ultraviolet region. In addition, other sensors 21 such as mechanical or magnetic sensors or ultrasonic sensors can be present for checking the bank notes.

The data captured by the sensor device 20 are transmitted to the control device 50. In the control device 50 or an evaluation unit additionally present, which can be contained in the control device 50 or is controlled by the control device 50, the data of the sensor device 20 are processed and evaluated. In so doing, properties of the respectively processed bank note, such as type (currency, denomination), authenticity, quality, state etc. are ascertained from the data of one or several sensors 21 by algorithms that are made available as software. The type, authenticity, quality, state etc. ascertained by the evaluation unit is made available to the control device 50.

Depending on the ascertained type, authenticity, quality, state etc. of the respective bank note BN, this is fed to one of several output pockets 30, 31 by the transport device 10 and stored therein. For example, in the first output pocket 30 there can be stored bank notes BN that were recognized as authentic, while bank notes BN classified as false or suspicious are stored in the second output pocket 31. For storing a bank note BN in the respective output pocket 30 or 31 the control device 50 actuates a first or second gate 11 or 12 of the transport device 10. As indicated by an extension 13 of the transport device 10, further output pockets can be provided. Likewise, other devices for storing or destroying bank notes can be provided, e. g. cassettes in which the bank notes can be stored protected from access, or a shredder. If a bank note BN could not have been recognized, it is transported, controlled by the control device 50, into one or several special output pockets, so that these bank notes can be processed separately, e. g. by the operator.

FIG. 2 shows a first embodiment of a sensor device in a first perspective. The sensor device 20 consists of a sensor 21 and a housing 22 protecting the sensor 21 from soiling. The housing 22 has a region 23 transparent to the sensor 21, which region 23 is arranged in such a way in the direction of the transport device 10, that bank notes transported past the sensor 21 in the transport direction T can be captured by the sensor 21. The sensor 21 can be for example an optical sensor, in particular a line-scan camera. In this case the transparent region 23 can be formed for example by a window made of glass, which is transmissive to the spectral region capturable by the sensor 21. For cleaning the sensor device 20 or the transparent region 23, a cleaning device 25 is provided. The cleaning device 25 can produce a gas stream along the sensor device 20 or the transparent region 23 to remove dirt, in particular dust, that is present there. The cleaning device 25 can be formed for example by a compressed air reservoir having a valve.

The transport device 10 is formed, in the represented embodiment, by belts 15 that are guided by rollers or rolls 16. The rollers 16 can also be powered to move the belts 15 in the transport direction T. As it appears better from FIG. 3, several belts 15, for example three, are arranged side by side in such a way that the bank notes to be transported are clamped between the belts 15 or between the belts 15 and further belts or guiding plates and transported. The belts 15 can be configured as flat or round belts or with any other cross-section. The arrangement and number of the belts 15 results from the size of the bank notes to be transported as well as from the type of transport, i. e. whether the bank notes are transported parallel to their long edges or parallel to their short edges.

After ascertainment of a soiling of the sensor device 20 or of the transparent region 23, e. g. by measuring the forward or backward scatter at the dirt particles, or as described in EP 1 064 624 B1, or after the expiry of a certain time or after the processing of a certain amount of bank notes, the sensor device 20 or the transparent region 23 is cleaned by means of the cleaning device 25. Controlled by the control device 50, a gas stream 25' is generated by means of the cleaning device 25, which gas stream cleans the sensor device 20 or the transparent region 23. Simultaneously to or shortly before the actuation of the cleaning device 25 by the control device 50, the control device 50 actuates means 17, 18, 19 that enlarge the distance between sensor device 20 or the transparent region 23 and the transport device 10 or the belts 15. For example, a lifting magnet 17 moves a ram 18 that has a guiding device 19 attached to it that moves the belts 15 in a direction away from the sensor device 20 into a position of the belts 15' with greater distance. For the actuation of the means 17, 18, 19 shortly before the actuation of the cleaning device 25, a predetermined time span can be allowed for by the control device 50, which time span allows for the inertia of the means 17, 18, 19 as well as of the belts 15 moved by the means 17, 18, 19. A corresponding time span for example can be input by an operator by means of the input/output device 40 and stored in the control device 50.

The above-described cleaning of the sensor device 20 or of the transparent region 23 as well as the enlarging of the distance between sensor device 20 and transport device 10 is advantageously effected in a processing pause, i. e. at a time at which no bank notes are transported past the sensor device 20, the transport device 10, however, is active. In this case, in the bank note processing machine 1, when this for example processes 33 bank notes per second and a space of 25 cm is provided per bank note, the belts 15 of the transport device are moved with a transport speed of 8.25 m/s. If the compressed-air pulse of the cleaning device 25 lasts for example one second, in the represented embodiment 3*8.25 m belt 15 are transported past the sensor device 20. If the distance between sensor device 20 and transport device 10, that is required for the operation, is maintained, there is the danger of the dirt adherent to a transport length of altogether approx. 25 m belt 15 coming off through the compressed-air pulse and reaching the transparent region 23 through the dynamic negative pressure due to the Bernoulli effect, leading to a new soiling of the sensor device 20 or of the transparent region 23. By enlarging the distance between sensor device 20 and transport device 10 this new soiling is avoided, however, since the belts 15 are not directly hit by the compressed-air pulse and the above-described negative pressure has likewise no effect on the dirt of the belts 15. It is obvious, that the above-described cleaning can also be performed, when the transport device 10 is stopped. In this case, the above-described advantages with respect to avoiding a new soiling are lower, however, since the transport device or the belts 15 do not continually transport new dirt into the region of the sensor device 20 or of the transparent region 23.

As to be seen in FIG. 3, the guiding device 19 can be configured such that it grasps all the belts 15 simultaneously and moves them away from the sensor device 20. The guiding device 19 can be manufactured for example from sheet metal and have a skid-shaped profile, while the surface coming into contact with the belts 15 can be polished or otherwise heat-treated, so that upon contact with the belts 15 an as low a friction as possible arises. Preferably, the guiding device 19 consists of a hardened material, so that wear is low.

Instead of on only one side of the sensor device 20, means 17*a*, 18*a* for enlarging the distance between sensor device 20 and transport device 10 can also be provided on both sides of the sensor device 20, as represented in the second embodiment in FIG. 4. Likewise, it is possible to employ, instead of the above-described guiding device 19, the above-described rollers or rolls 16 of the transport system 10. These are then moved by means of a lifting magnet 17*a* and a ram 18*a*, as described above for FIG. 2.

One has hitherto started out from the fact that the enlargement of the distance between sensor device 20 and transport device 10 is achieved by shifting the transport device 10 or parts of the transport device 10. But it is also possible to achieve the enlargement of the distance by shifting the sensor device 20 away from the transport device 10. Shifting the transport device 10 away from the sensor device 20 is preferred, however, since the sensor device 20 usually must be exactly adjusted in the bank note processing machine 1, which increases the effort for a movable sensor device 20.

The function of the described bank note processing machine was explained with reference to the processing of bank notes. It is obvious that with the bank note processing machine there can be processed other papers of value, besides bank notes, e. g. checks, coupons, vouchers etc.

The invention claimed is:

1. A sensor device in a bank note processing machine, comprising:

a transport device arranged to transport bank notes to be processed past a sensor device;

a cleaning device arranged to clean the sensor device or a transparent region of the sensor device;

a control device controlling the constituents of the bank note processing machine;

means for enlarging a distance between the transport device and the sensor device, wherein the control device drives the means and the cleaning device in such a way that the distance between the transport device and the sensor device is enlarged by the means during the cleaning of the sensor device by the cleaning device.

2. The sensor device according to claim 1, wherein the means move the transport device or belts of the transport device away from the sensor device.

3. The sensor device according to claim 2, wherein the means are formed by a lifting magnet and a guiding device acting on the belts.

4. The sensor device according to claim 3, wherein the guiding device is formed by a skid-shaped sheet-metal part.

5. The sensor device according to claim 3, wherein the guiding device is formed by rolls or rollers.

6. The sensor device according to claim 1, wherein the means for enlarging the distance between the transport device and the sensor device are arranged on one side of the sensor device, regarded in the transport direction of the transport device.

7. The sensor device according to claim 1, wherein the means for enlarging the distance between the transport device and the sensor device includes a first actuator arranged on a first side of the sensor device in the transport direction of the transport device and a second actuator arranged on a second side of the sensor device in the transport direction of the transport device.

8. A sensor device in a bank note processing machine, comprising:

a transport device arranged to transport bank notes to be processed past a sensor device;

a cleaning device arranged to clean the sensor device or a transparent region of the sensor device;

a control device controlling the constituents of the bank note processing machine;

an enlarging device arranged for enlarging a distance between the transport device and the sensor device, wherein the control device drives the enlarging device and the cleaning device in such a way that the distance between the transport device and the sensor device is enlarged by the enlarging device during the cleaning of the sensor device by the cleaning device.

9. The sensor device according to claim 8, wherein the enlarging device includes a lifting magnet and a guiding device acting on the belts.

10. A sensor device in a bank note processing machine, comprising:

a transport device arranged to transport bank notes to be processed past a sensor device;

a cleaning device arranged to clean the sensor device or a transparent region of the sensor device;

a control device controlling the constituents of the bank note processing machine;

an actuator configured to enlarge a distance between the transport device and the sensor device, wherein the control device drives the means and the cleaning device in such a way that the distance between the transport device and the sensor device is enlarged by the means during the cleaning of the sensor device by the cleaning device.

11. The sensor apparatus according to claim 10, wherein the actuator moves the transport device or belts of the transport device away from the sensor device.

12. The sensor apparatus according to claim 11, wherein the actuator includes a lifting magnet and a guiding device acting on the belts.

13. The sensor apparatus according to claim 12, wherein the guiding device is formed by a skid-shaped sheet-metal part.

14. The sensor apparatus according to claim 12, wherein the guiding device is formed by rolls or rollers.

15. The sensor apparatus according to claim 10, wherein the actuator is arranged on one side of the sensor device, regarded in the transport direction of the transport device.

16. The sensor apparatus according to claim 10, wherein the actuator includes a first actuator device arranged on a first side of the sensor device in the transport direction of the transport device and a second actuator device arranged on a second side of the sensor device in the transport direction of the transport device.

* * * * *